United States Patent [19]

Lemin

[11] 4,063,694

[45] Dec. 20, 1977

[54] WIRE REEL DEVICE

[76] Inventor: Norman Phillip Lemin, Purton Road, Pakenham, Victoria, 3810, Australia

[21] Appl. No.: 662,259

[22] Filed: Feb. 27, 1976

[30] Foreign Application Priority Data

Mar. 3, 1975 Australia ..... 0763/75

[51] Int. Cl.[2] ..... B65H 49/32; B65H 59/02

[52] U.S. Cl. ..... 242/85; 242/78; 242/84; 242/106; 242/110; 242/129

[58] Field of Search ..... 242/106, 129, 85, 78, 242/79, 84, 81, 78.6, 86.5, 129.8, 58.6, 128, 55.54, 104, 103, 156, 129.7, 130.2, 75.4, 139, 137, 110, 110.1, 55.42, 80, 54 R

[56] References Cited

U.S. PATENT DOCUMENTS

| | | | |
|---|---|---|---|
| 1,215,454 | 2/1917 | Winchell | 242/86.5 R |
| 1,661,932 | 3/1928 | Elliott | 242/55.42 |
| 2,152,559 | 3/1939 | Moslo | 242/85 |
| 2,264,149 | 11/1941 | Grimshaw | 242/85 |
| 2,628,040 | 2/1953 | Rayburn | 242/78 |

*Primary Examiner*—George F. Mautz

*Attorney, Agent, or Firm*—Cushman, Darby & Cushman

[57] ABSTRACT

A wire reel device comprising reel means for carrying a coil of wire, means mounting the reel means for rotation during use about a generally vertical axis, the mounting means including pivot means whereby the reel means is movable from a first vertical position where the wire can be payed out to a second generally horizontal position where a coil of wire can be loaded onto the reel means.

3 Claims, 4 Drawing Figures

WIRE REEL DEVICE

This invention relates to wire reel devices.

It is known to carry wire, particularly barbed wire, plain wire, chain wire and boundary fence wire such as ringlock or like, on reels which are mounted on a prime mover such as a tractor, utility, truck or other vehicle so as to rotate about a horizontal axis. In use, wire is payed out and, if the wire is chain wire or boundary fence wire, or otherwise is comprised of a plurality of spaced strands, the wire must be lifted for attachment to fence posts. Lifting of part of the wire is resisted by that part of the wire which has not been lifted and lifting of the whole length of wire at one time is impractical.

The present invention provides a wire reel device comprising reel means for carrying a coil of wire, and a mount for mounting the reel means for rotation, in use, about a generally vertical axis, and including pivot means whereby the reel means is made movable from a first position in which its axis is generally vertical to a second position in which its axis is generally horizontal.

As a result, wire may be payed out when the reel means is in said first position but the loading of a coil of wire onto the reel means is facilitated when the reel means is in said second position.

In a preferred aspect this invention provides a wire reel comprising reel means for carrying a coil of wire, upper and lower mounts for mounting the reel means for rotation about a generally vertical axis, and pivot means and constructed and arranged such that the reel means is disengageable from the upper mount whereby to be enabled to pivot about said pivot means from a first position in which its axis is generally vertical to a second position in which its axis is generally horizontal.

The pivot means may operate to pivot the lower mount but it is preferred that it is intermediate the upper and lower mounts.

A preferred form of pivot means is a flexible coupling such as an universal joint in an axle on which the reel means is mounted. One particular flexible coupling comprises a yoke mounting a pivot pin and means engaged with the pivot pin. In a particular form of this the pivot pin is removable so that the reel means may also be disengaged from the lower mount.

The upper mount preferably comprises a bearing, preferably a thrust bearing, through which an axle passes and in this it is preferred that the upper end of the reel means and the lower end of that axle have releasably engageable means such as a hook and eye. To enable engagement and disengagement of that means it is preferred that the upper mount is movable in the direction of said generally vertical axis. It is also preferred that the upper mount is movable in that direction so as to vary the spacing of the upper and lower mounts and thus vary the axial length of reel means accommodatable by the device.

A brake is preferably provided and is operable to restrict rotation of the reel means about said generally vertical axis so as to be useful in preventing overrrun of the reel means. It is preferred that the brake is brought into operation by moving the reel means axially and thus the aforesaid movement of the upper mount can conveniently be used to engage and disengage the brake.

The mounting means may be made movable as aforesaid by hydraulic jack means, rack and pinion or in any other suitable way.

A handle may be provided for rewinding wire on to the reel means.

A fair lead may be provided for guiding wire being payed out from the reel means and preferably may be located in a number of different positions to suit the clockwise or anticlockwise coiling of the wire and/or to suit the direction in which the wire is to be payed out.

The device may include mounting means whereby it may be attached to a prime mover such as a tractor, utility, truck or other vehicle and the mounting means is preferably such that the device, insofar as the reel means is concerned, may be centrally located behind the vehicle or swung to a selected side to suit fencing which is to be done.

Other mounting means such as legs may be provided in lieu or additionally.

A specific construction of a wire reel device in accordance with this invention will now be described with the aid of the accompanying drawings in which.

Figure 1:
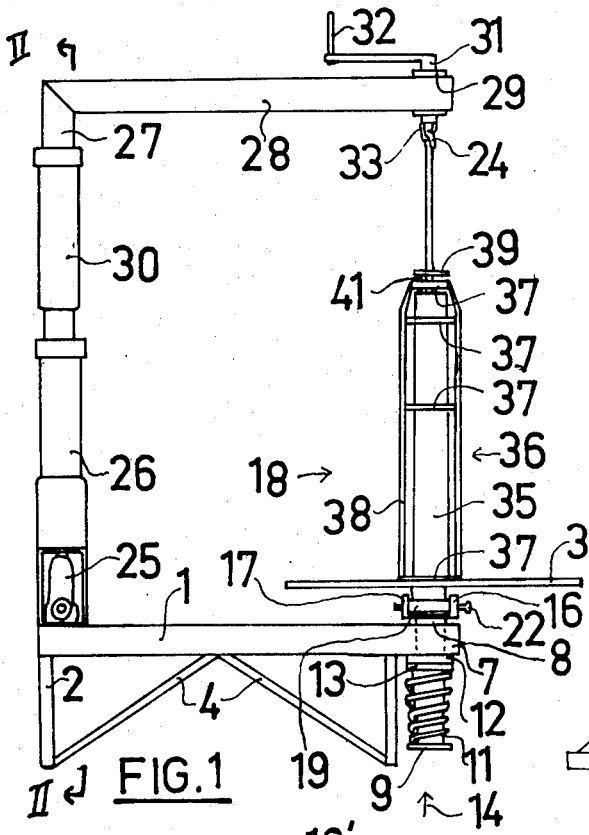
FIG. 1 is an elevational view of the device.
Figure 2:
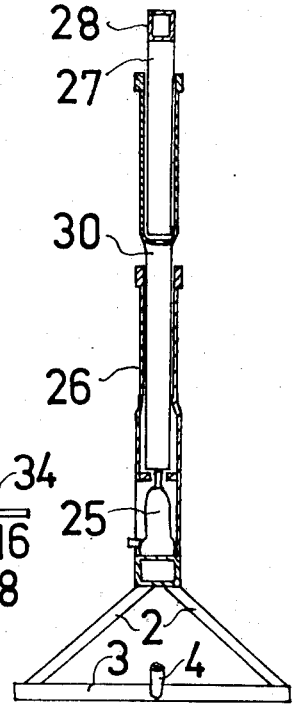
FIG. 2 is a cross-sectional view on line II — II in FIG. 1.

As shown in the drawings, the device comprises a beam 1 which is mounted on legs 2, bars 3 and is braced by braces 4.

At its end 7 the beam 1 has a bearing (not shown) in which an axle 8 is rotatably mounted. The axle 8 is movable axially and carries a plate 9 which acts as an abutment for a spring 11 which in turn abuts on an annulus 12. A second annulus 13 is attached to the beam 1. By moving the axle 8 in the direction of the arrow 14, the plate 9 will bear on the spring 11 which will bear on the annulus 12 and force it into frictional engagement with annulus 13 to thereby act as a brake to restrict rotation of the axle 8.

Figure 3:
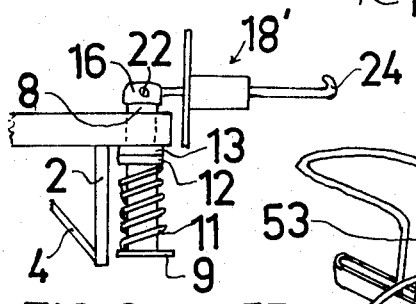
FIG. 3 is a fragmentary elevational view of the device and shows it is another condition.

The axle 8 has a yoke comprised of arms 16 and 17 and a reel 18 carries a sleeve 19. A pivot pin 22 joins the yoke and sleeve and makes the reel 18 pivottable from an axis vertical position as shown in FIG. 1, to an axis horizontal position as shown in FIG. 3.

The upper end of the reel 18 carries a hook 24.

Also mounted on the beam 1 is a telescopic post comprised of members 26 and 27 and a removable spaced member 30. The member 27 carries an arm 28. The post is made telescopable by a hydraulic jack 25 so that the arm 28 can be raised or lowered.

The arm 28 supports a thrust bearing 29 in which a shaft 31 is rotatably mounted. The upper end of the shaft carries a handle 32 and the lower end mounts an eye 33.

By lowering the arm 28 the hook 24 and eye 33 are disengageable to allow the reel 18 to take up the position shown in FIG. 3 so that a coil of wire can be conveniently loaded on to the reel 15.

Thereafter, the reel is lifted to the position shown in FIG. 1 whereupon the hook 24 and eye 33 can be reengaged and the arm 28 can be lifted to prevent disengagement of the hook and eye.

It will also be realized that raising of the arm 28 will cause the annuli 12 and 13 to engage and act as a brake and the extent of braking can be controlled by the amount that the arm 28 is raised.

The reel 18 comprises the aforementioned sleeve 19 and hook 24 and also includes a platform 34 and centre 35. As shown in FIG. 1, the reel 18 also includes a sleeve 36 in the form of a cage about centre 35. The sleeve 36 comprises annuli 37 and rods 38 and the sleeve 36 is made non-rotatable by a plate 39 having a pin 41 which passes through one of the annuli 37 into the centre 35. The sleeve 36 is particularly suitable for carrying boundary fence wire but may be removed when not required.

In use of the device, the hook 24 and eye 33 are disengaged by lowering arm 28 and the reel is moved to the position shown in FIG. 3. A coil of wire is loaded onto the reel and the device is then returned to the condition shown in FIG. 1.

The device is positioned on a prime mover and the free end of the coil of wire is then fixed to a strainer post and the arm 28 is raised to provide the desired amount of braking of rotation of reel 18.

The prime mover may then be driven through the brake of the device to pay out the wire which, assuming it to be boundary fence wire or like, will remain vertical. Attachment of the wire to fence posts may be done without having to lift the wire.

The device may be detached as a unit from the prime mover and is free standable and this enables it to be used to erect temporary fencing such as for strip grazing and, when desired, the wire may be rewound by the handle 32.

Further, if desired, the device may be tipped so that the telescopic post is horizontal and it and the legs 2 support the device.

The device may be provided with reels of different size such as of different diameter or axial length to suit a particular coil of wire.

Figure 4:
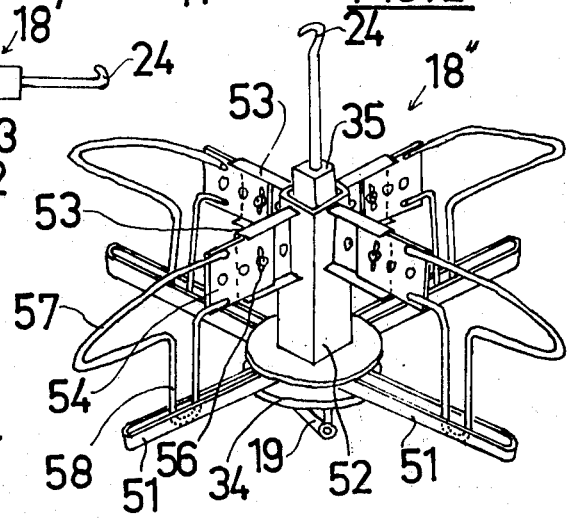
FIG. 4 is a perspective view of an alternative reel for use with the device of FIG. 1.

One different reel 18′ is shown in FIG. 4 and differs from the reel 18 shown in FIG. 1 in that the sleeve 36 is omitted and the reel 18′ is of shorter axial length. In using reel 18′ the spacer member 30 will be removed so as to bring the arm 28 closer to the beam 1.

Another reel 18″ is shown in FIG. 4. The reel 18″ comprises a platform 34, centre 35′ which is of square cross-section and hook 24. The reel 18″ further includes guide rails 51 and a sleeve 52 having channel members 53 which guide plates 54 for radial sliding movement.

The plates 54 are adjustably mounted by means of bolts passed through holes in the members 53 and plates 54 and which bolts are secured by wing nuts 56.

The plates 54 support arms 57 which have U-shaped portions 58 which are received between the guide rails 51.

The reel 18″ is particularly of use in that its diameter is adjustable to suit different diameters of wire. Also when wire is being rewound upon it there will be a tendency for the wire to wind so tight as to make its removal difficult but by undoing the wing nuts 56 and moving the plates 54 and hence the portions 58 radially inward the effective diameter of the reel can be reduced to enable the wire to be easily removed.

Other reels may be provided which are in part insulated to hold electric fence wire. In one particular instance plastic reels are simply slipped over the centre 35 and held against rotation on the centre 35 by means of a rod passed through a hole in the plastic reels and into a hole in the platform.

Many modifications may be made to the above described device. For instance, it may be provided with hitch means whereby it may be secured to drawbar or 3-point linkage of a tractor or like. Further, the crank handle may be provided with a geared drive to make winding in of wire easier or a motorized drive may be provided. In another modification the telescopic post has two arms, reels and brake means on opposite sides of it so that the device may carry up to eight reels of wire.

The above described device will be found to be a boon to fencing contractors and others erecting fences.

Modifications and adaptions may be made to the above described without departing from the spirit and scope of this invention which includes every novel feature and combination of features disclosed herein.

I claim:

1. A wire reel device, comprising:

a frame;

an axle and means mounting the axle on the frame for rotation about a generally vertical axis;

a wire reel including means for mounting a coil of wire thereon for rotation with the wire reel, said reel having two opposite ends spaced apart along a longitudinal axis thereof;

means mounting said reel, centrally of one end thereof, upon said axle for rotation with said axle, said mounting means including a pivot member having a generally horizontal axis permitting said mounting means to be articulated about said horizontal axis between a first position wherein said reel axis is generally horizontal and a second position wherein said reel axis is generally vertical;

an arm means secured on said frame and extending to a location above said axle;

a first connector on the arm means and a second connector on the opposite end of said reel, these two connectors being engageable when said mounting means is in said second position; said connectors, at least when engaged, including means providing for relative rotation between said arm means and said reel about a generally vertical axis, so that said reel may be rotated in a sense to rotatively pay-out or take-up wire when said connectors are engaged;

said arm means including means for raising and lowering the effective height of said first connector for exerting a varied degree of upward pull upon said reel.

2. The wire reel device of claim 1;

further comprising a first braking element on said axle and a second braking element on said frame, these two braking elements being engageable to frictionally retard rotation of said axle and thus said reel, whereby said means for raising and lowering may be operated to increase and decrease frictional retardation of rotation of said axle and thus said reel.

3. A wire reel device, comprising:

reel means for carrying a coil of wire, said reel means having a longitudinal axis;

upper and lower mounts for mounting the reel means for rotation about a generally vertical axis coincident with said longitudinal axis;

horizontal axis pivot means included in said lower mount, the reel means being disengageable from said upper mount, whereupon the reel means may be pivoted about said horizontal axis pivot means between a first position wherein said reel means axis is generally vertical and a second position wherein said reel means axis is generally horizontal;

the brake means engageable with the reel means for selectively restricting rotation of the reel means about said vertical axis when said reel means is in said first position;

brake means comprising a first surface on the reel means which is rotatable with the reel means, and means providing a second, stationary surface;

means movably mounting the upper mount for axial movement while connected with said reel means between one position wherein the first and second surfaces are engaged and another position wherein the first and second surfaces are disengaged.

* * * * *